US009785081B1

(12) United States Patent
Mitsui

(10) Patent No.: US 9,785,081 B1
(45) Date of Patent: Oct. 10, 2017

(54) CHARGING DEVICE AND IMAGE FORMING APPARATUS

(71) Applicant: FUJI XEROX CO., LTD., Tokyo (JP)

(72) Inventor: Taro Mitsui, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/225,135

(22) Filed: Aug. 1, 2016

(30) Foreign Application Priority Data

Mar. 29, 2016 (JP) ..... 2016-065086

(51) Int. Cl.
*G03G 15/02* (2006.01)

(52) U.S. Cl.
CPC ..... *G03G 15/0225* (2013.01); *G03G 15/0258* (2013.01)

(58) Field of Classification Search
CPC ..... G03G 15/0225; G03G 15/0258; G03G 2215/021
USPC ..... 399/100, 176
See application file for complete search history.

(56) References Cited

U.S. PATENT DOCUMENTS 7,272,344 B2 * 9/2007 Miura ..... G03G 21/0011 399/176 X
2001/0038764 A1 * 11/2001 Kubo ..... G03G 21/0011 399/350
2007/0292158 A1 * 12/2007 Matsumoto ..... G03G 15/0225 399/100
2010/0104320 A1 * 4/2010 Moon ..... G03G 15/02 399/176 X
2012/0107012 A1 * 5/2012 Amemiya ..... G03G 15/0225 399/100
2013/0251393 A1 * 9/2013 Yamaguchi ..... G03G 15/0225 399/100

FOREIGN PATENT DOCUMENTS

JP 2007-033856 A * 2/2007
JP 2007-121892 A 5/2007
JP 2013-140274 A * 7/2013

OTHER PUBLICATIONS

Machine translation of JP 2007-033856 A (publication date of Feb. 8, 2007) printed on Feb. 14, 2017.*
Machine translation of JP 2013-140274 A (publication date of Jul. 18, 2013) printed on Feb. 14, 2017.*

* cited by examiner

*Primary Examiner* — Sophia S Chen
(74) *Attorney, Agent, or Firm* — Oliff PLC

(57) ABSTRACT

A charging device includes a charging member, a cleaning member, and first and second support members. The charging member rotates around a rotation shaft and charges of an image holding member. The rotation shaft of the charging member is disposed parallel to a rotation shaft of the image holding member. The cleaning member rotates around a rotation shaft and cleans the charging member. The rotation shaft of the cleaning member is disposed to incline with respect to the rotation shaft of the charging member. The first support member supports one end of the charging member and one end of the cleaning member. The second support member supports the other end of the charging member and the other end of the cleaning member, has the same configuration as a configuration of the first support member, and is disposed symmetrically with the first support member with the charging member interposed therebetween.

2 Claims, 9 Drawing Sheets

Prior Art

CHARGING DEVICE AND IMAGE FORMING APPARATUS

CROSS-REFERENCE TO RELATED APPLICATIONS

This application is based on and claims priority under 35 USC 119 from Japanese Patent Application No. 2016-065086 filed Mar. 29, 2016.

BACKGROUND

Technical Field

The invention relates to a charging device and an image forming apparatus.

SUMMARY

According to an aspect of the invention, a charging device includes a charging member, a cleaning member, a first support member and a second support member. The charging member rotates around a rotation shaft of the charging member and charges a surface of an image holding member by being in contact with the surface of the image holding member. The rotation shaft of the charging member is disposed parallel to a rotation shaft of the image holding member. The cleaning member rotates around a rotation shaft of the cleaning member and cleans the charging member by being in contact with the charging member. The rotation shaft of the cleaning member is disposed to incline with respect to the rotation shaft of the charging member. The first support member supports one end portion of the charging member and supports one end portion of the cleaning member. The second support member supports the other end portion of the charging member, supports the other end portion of the cleaning member, has the same configuration as a configuration of the first support member, and is disposed symmetrically with the first support member with the charging member interposed between the first and second support members.

BRIEF DESCRIPTION OF THE DRAWINGS

Exemplary embodiments of the present invention will be described in detail based on the following figures, wherein:

FIGS. 2A and 2B are explanatory views of a charging device and an image holding member of Example 1, of which FIG. 2A is a perspective view, and FIG. 2B is a view that is viewed in the arrow IIB direction of FIG. 2A;

FIGS. 3A and 3B are explanatory views of the charging device of Example 1, of which FIG. 3A is a perspective view, and FIG. 3B is an enlarged view of a main portion;

FIGS. 5A and 5B are explanatory views of a support member of Example 1, of which FIG. 5A is a perspective view, and FIG. 5B is a view that is viewed in the arrow VB direction of FIG. 5A;

FIGS. 6A and 6B are explanatory views in a case where a charging roll is inclined with respect to a photoconductor, of which FIG. 6A is an explanatory view of an upstream side, and FIG. 6B is an explanatory view of a downstream side;

FIGS. 9A and 9B are explanatory views of a support member of Example 2, of which FIG. 9A is a perspective view, and FIG. 9B is a view that is viewed in the arrow IXB direction of FIG. 9A.

DETAILED DESCRIPTION

Figure 1:
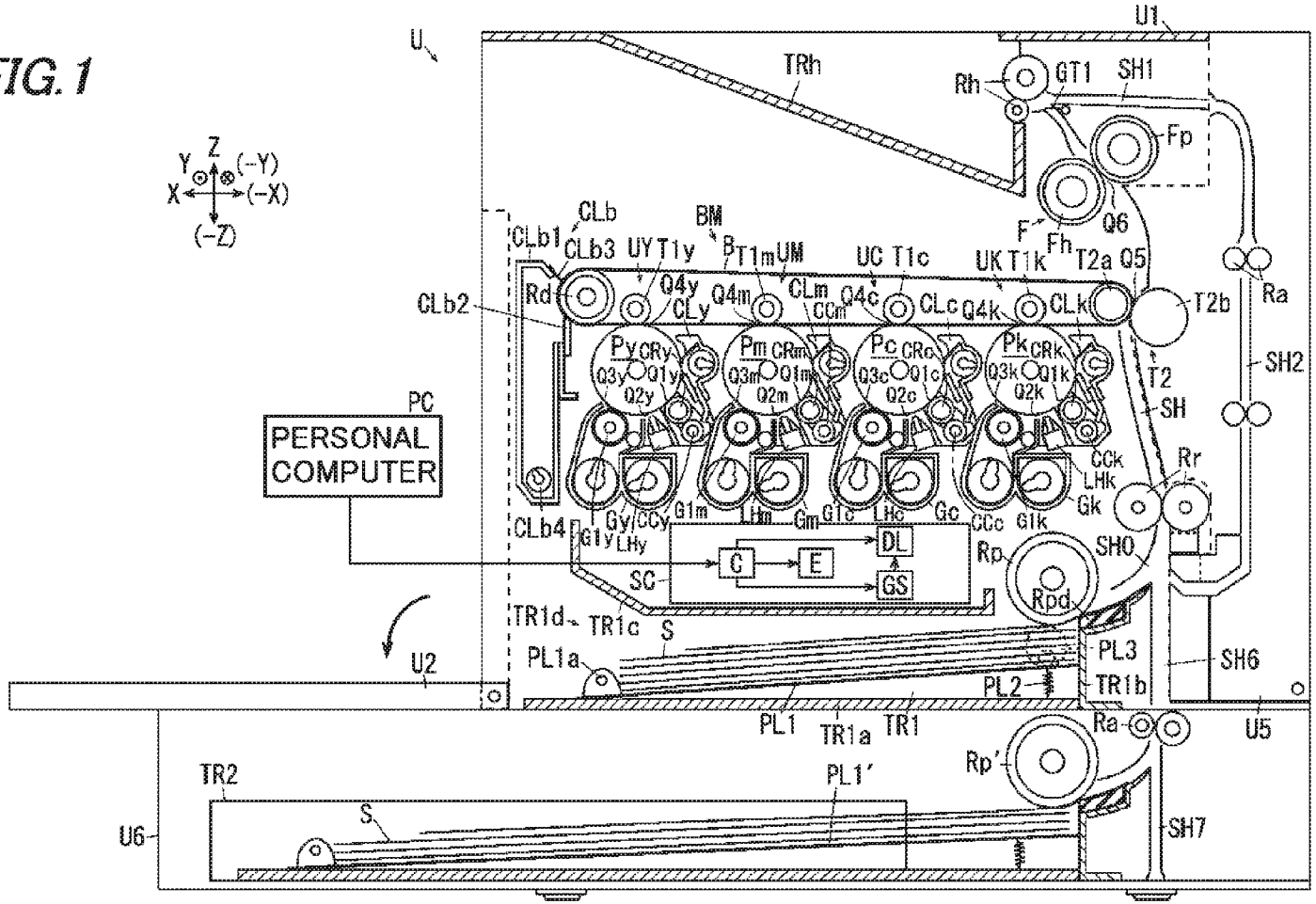
FIG. 1 is an explanatory view of a printer of Example 1 of the invention.

Next, examples that are specific examples of exemplary embodiments of the invention will be described with reference to the drawings, but the invention is not limited to the following examples.

Moreover, in order to facilitate understanding the following description, in the drawings, a forward and rearward direction is an X-axis direction, a rightward and leftward direction is a Y-axis direction, an upward and downward direction is a Z-axis direction, directions or sides indicated by arrow X, −X, V, −Y, Z, and −Z are respectively forward, rearward, rightward, leftward, upward, and downward or a front side, a rear side, a right side, a left side, an upper side, and a lower side.

In addition, in the drawings, a mark in which "." is described in "O" means an arrow directed from the rear side to the front side of a paper surface and a mark in which "x" is described in "O" means an arrow directed from the front side to the rear side of the paper surface.

Moreover, in the following description using the drawings, in order to facilitate understanding, illustration other than members necessary for the description is appropriately omitted.

EXAMPLE 1

FIG. 1 is an explanatory view of a printer of Example 1 of the invention.

In FIG. 1, a printer of Example 1 of an image forming apparatus of the invention has an apparatus main body U1. In a front surface of the apparatus main body U1, a front cover U2, which is an example of an opening and closing member for supplementing a medium, is supported to be opened and closed around a lower end thereof when supplementing a new medium. The front cover U2 is supported movably between an opened position indicated by a solid line of FIG. 1 in which a sheet that is an example of the medium is able to be inserted and a closed position indicated by a broken line of FIG. 1. An exit tray TRh as an example of an ejection portion is provided on an upper surface of the apparatus main body U1.

In FIG. 1, a control substrate SC, in which various control circuits, storage medium, and the like are disposed, is disposed in a lower portion of the printer U. A controller C that performs various controls of the printer U, an image processing portion GS that controls an operation by the controller C, a writing drive circuit DL as an example of a drive circuit of a latent image forming device, a power supply circuit E as an example of a power supply device, and the like are provided in the control substrate SC. The power supply circuit E applies a voltage to charging rollers CRy to CRk as an example of a charging member, developing rollers G1*y* to G1*k* as a example of a developing member, primary transfer rollers T1*y* to T1*k* as an example of a transfer device, and the like.

The image processing portion GS converts printing information input from a personal computer PC as an example of a transmitting device of image information electrically connected to the apparatus main body U1 into image information for latent image formation corresponding to an image of four colors of yellow, magenta, cyan, and black, that is, Y, M, C, and K, and outputs the printing information to the writing drive circuit DL at time which is set in advance.

Moreover, if an original document image is a single color image, that is, in a case of monochrome image, image information of only black is input into the writing drive circuit DL.

The writing drive circuit DL has a drive circuit (not illustrated) of each color of Y, M, C, and K and outputs a signal in accordance with input image information to LED heads LHy, LHm, LHc, and LHk as an example of a latent image forming device disposed for each color at a predetermined time.

In FIG. 1, an image forming devices UY, UM, UC, and UK as an example of a visible image forming device for forming a toner image as an example of a visible image of each color of yellow, magenta, cyan, and black are disposed above the control substrate SC. In FIG. 1, the image forming device UK of black, that is, K color has a photoconductor Pk as an example of an image holding member that is rotated. The charging roller CRk as an example of a charger for charging a surface of the photoconductor Pk, the LED head LHk as an example of the latent image forming device for forming an electrostatic latent image on a surface of the photoconductor Pk, the developing device Gk that develops the electrostatic latent image on the surface of the photoconductor Pk into the visible image, a photoconductor cleaner CLk as an example of a clean device for the image holding member for removing developer remaining on the surface of the photoconductor Pk, and the like are disposed around the photoconductor Pk.

The image forming device UY, UM, and UC of the other colors are also configured similar to the image forming device UK of black.

Surfaces of the photoconductors Py to Pk are uniformly charged by the charging rollers CRy to CRk in charging regions Q1*y*, Q1*m*, Q1*c*, and Q1*k* facing the charging rollers CRy to CRk and then the latent image is written by the LED heads LHy to LHk in latent image forming regions Q2*y*, Q2*m*, Q2*c*, and Q2*k*. The written electrostatic latent image is developed to the toner image in charging regions Q3*y*, Q3*m*, Q3*c*, and Q3*k* facing the developing devices Gy to Gk. The developed toner image is transported to primary transfer regions Q4*y*, Q4*m*, Q4*c*, and Q4*k* being in contact with an intermediate transfer belt B as an example of an intermediate transfer body. In the primary transfer regions Q4*y*, Q4*m*, Q4*c*, and Q4*k*, a primary transfer voltage of a charging polarity opposite to a charging polarity of toner at time which is set in advance is applied from the power supply circuit E controlled by the controller C to the primary transfer rollers T1*y*, T1*m*, T1*c*, and T1*k* as an example of a primary transfer device disposed on a back side of the intermediate transfer belt B.

The toner image on each of the photoconductors Py to Pk is primarily transferred to the intermediate transfer belt B by the primary transfer rollers T1*y*, T1*m*, T1*c*, and T1*k*.

Residue and deposits such as transfer residual toner and discharge products of the surfaces of the photoconductors Py, Pm, Pc, and Pk after primary transfer are cleaned by the photoconductor cleaners CLy, CLy, CLc, and CLk. The cleaned surfaces of the photoconductors Py, Pm, Pc, and Pk are charged again by the charging rollers CRy, CRm, CRc, and CRk.

Charging cleaners CCy, CCm, CCc, and CCk as an example of the cleaning member of the charging member are in contact with the charging rollers CRy to CRk. Therefore, the charging cleaners CCy to CCk remove the residue and the like adhered to the charging rollers CRy to CRk, which are not removed by the photoconductor cleaners CLy to CLk.

In FIG. 1, a belt module BM as an example of an intermediate transfer unit is disposed above the photoconductors Py to Pk. The belt module BM, which is an example of a transfer receiver, has the intermediate transfer belt B as an example of the intermediate transfer body. The intermediate transfer belt B is rotatably supported by an intermediate transfer sufficient system configured of a belt driving roller Rd as an example of a drive member, a backup roller T2*a* as an example of a driven member and as an example of a secondary transfer facing member, and the primary transfer rollers T1*y*, T1*m*, T1*c*, and T1*k* disposed to face each of the photoconductors Py to Pk.

A belt cleaner CLb as an example of an intermediate transfer body cleaning unit is disposed on a front side of the intermediate transfer belt B. The belt cleaner CLb has a cleaning container CLb1 that extends in the upward and downward direction, a cleaning blade CLb2 as an example of a cleaning member that is supported on the cleaning container CLb1, is in contact with the intermediate transfer belt B, removes and cleans the residue remaining on the surface of the intermediate transfer belt B, a film CLb3 as an example of a leakage preventing member that prevents the residue removed by the cleaning blade CLb2 from being scattered and leaked, and a residue transport member CLb4 that is disposed in a lower end portion of the cleaning container CLb1, drains and transports the removed residue to a recovery container (not illustrated). Moreover, a lower end of the cleaning container CLb1 of Example 1 in the upward and downward direction is set in a lower end of the image forming devices UY to UK, that is, in a position corresponding to a lower end position of the developing devices Gy to Gk.

A secondary transfer roll T2*b* as an example of a secondary transfer member is disposed to face the surface of the intermediate transfer belt B being in contact with the backup roller T2*a*. A secondary transfer device T2 of Example 1 is configured of the backup roller T2*a* and the secondary transfer roll T2*b*. In addition, a secondary transfer region Q5 is formed by a region facing the secondary transfer roll T2*b* and the intermediate transfer belt B.

In the primary transfer regions Q4*y*, Q4*m*, Q4*c*, and Q4*k*, a monochromatic color or multi-color toner image sequentially overlapped and transferred on the intermediate transfer belt B by the primary transfer rollers T1*y*, T1*m*, T1*c*, and T1*k* is transported to the secondary transfer region Q5.

A transfer device of Example 1 is configured of the primary transfer rollers T1*y* to T1*k*, the intermediate transfer belt B, the secondary transfer device T2, and the like.

A manual feed tray TR1 as an example of a loading portion of the medium is provided below the control substrate SC. The manual feed tray TR1 has a bottom wall TR1*a* as an example of a lower wall, a rear end wall TR1*b* extending upwardly from a rear end of the bottom wall TR1*a*, and an upper wall TR1*c* disposed to face an upper side of the bottom wall TR1*a*. A supplement port TR1*d* for supplementing new recording sheets S is formed in a front end portion of the manual feed tray TR1. The front end portion of the upper wall TR1*c* is formed to be inclined to the outside of the supplement port TR1*d*, that is, inclined upwardly to the front side. Therefore, the supplement port TR1*d* is formed such that a gap between the upper wall TR1*c* and the bottom wall TR1*a* is widened toward the front side and the supplement port TR1*d* is widened toward the front side.

As an example of a medium loading portion for moving up and down the recording sheet S, a moving-up-and-down plate PL1, which is rotatably supported around a rotation center PL1*a* and in which the recording sheet S as an example of a medium is loaded, is disposed above the bottom wall TR1*a*. A moving-up-and-down spring PL2 as an example of an urging member for urging the rear end portion of the moving-up-and-down plate PL1 is disposed in the rear end portion of the moving-up-and-down plate PL1. If the image formation is not performed, the moving-up-and-down plate PL1 is moved to a lowered position in which the moving-up-and-down plate PL1 is held in a state of being parallel to the bottom wall TR1*a* by eccentric cam-shaped push-down members PL3 disposed in both right and left end portions. Then, during performing the image formation, the push-down member PL3 is rotated and then the moving-up-and-down plate PL1 is movably supported on a moved-up position illustrated in FIG. 1 in which the moving-up-and-down plate PL1 is moved up by the moving-up-and-down spring PL2.

Therefore, if the front cover U2 is opened, the supplement port TR1*d* is opened on the outside, a bundle of the new recording sheets S is inserted until abutting against the rear end wall TR1*b*, is loaded on the moving-up-and-down plate PL1 of the lower portion, and is able to be housed.

A sheet feeding roll Rp as an example of a delivery member is disposed on a rear side of the upper wall TR1*c*. The sheet feeding roll Rp is disposed in a position in which the uppermost recording sheet S of the bundle of the loaded recording sheets S is pressed by a spring force of the moving-up-and-down spring PL2 in a state where the moving-up-and-down plate PL1 is moved to the moved-up position. A retard pad Rpd as an example of a separating member is disposed in an upper end of the rear end wall TR1*b*. Moreover, a first paper feeding path SH6 as an example of a first transporting path is formed on the right side of the manual feed tray TR1. The first paper feeding path SH6 extends in the upward and downward direction.

The recording sheets S loaded in the manual feed tray TR1 are delivered by the sheet feeding roll Rp, are separated one by one in a contact region between the retard pad Rpd and the sheet feeding roll Rp, and are transported to a manual path SH0. The recording sheets S of the manual path SH0 merges into the first paper feeding path SH6. A registration roller Rr as an example of a transport member and as an example of an adjusting member of a paper feeding is disposed in an upper end of the first paper feeding path SH6. The registration roller Rr delivers the recording sheet S to a medium transporting path SH toward the secondary transfer region Q5 in accordance with timing when the toner image of the intermediate transfer belt B reaches the secondary transfer region Q5.

The residue such as transfer residual toner and discharge products remaining on the surface is removed and then the intermediate transfer belt B is cleaned by the belt cleaner CLb after the toner image is transferred in the secondary transfer region Q5.

The recording sheets S to which the toner image is transferred is transported to a fixing region Q6 of a fixing device F. The fixing device F has a heating roll Fh as an example of a heating and fixing member, and a pressure roll Fp as an example of a pressing fixing member, and the fixing region Q6 is configured by a region in which the heating roll Fh and the pressure roll Fp are in contact with each other at a pressure which is set in advance. An unfixed toner of the surface of the recording sheet S is fixed by heat and the pressure during the recording sheet S passes through the fixing region Q6.

The recording sheet S to which an image fixed exits from exit rollers Rh as an example of an exit member of the medium to an exit tray TRh.

An additional connection path SH1 as an example of the transporting path for reversion that is branched from the medium transporting path SH and extends on the right side is formed on the right side of the exit rollers Rh. A gate GT1 as an example of a switching member is disposed in a branch portion between the additional connection path SH1 and the medium transporting path SH. The gate GT1 of Example 1 is configured of an elastically deformable member. When the recording sheet S transported through the medium transporting path SH passes through the gate GT1, the gate GT1 is elastically deformed by being pressed by the recording sheet S and thereby the recording sheet S is able to be transported to the exit rollers Rh. The gate GT1 is disposed such that if the recording sheet S passes through the gate GT1, the gate GT1 is elastically restorated and then is able to guide the recording sheet S from the exit rollers Rh to the additional connection path SH1.

In the printer U of Example 1, a reversing unit U5 is supported on the back side of the apparatus main body U1. A reverse path SH2 as an example of a second transporting path is formed on an inside of the reversing unit U5. An upstream end of the reverse path SH2 is connected to a right end of the additional connection path SH1 of the apparatus main body U1. A downstream end of the reverse path SH2 is joined to the first paper feeding path SH6 on the upstream side of the registration roller of the apparatus main body U1.

Therefore, in a case where duplex printing is performed, if the recording sheet S where the image is recorded on a first surface is transported in the medium transporting path SH and a trailing end thereof in the transporting direction passes through the gate GT1, the exit rollers Rh is reversely rotated and the recording sheet S is delivered to the additional connection path SH1 and the reverse path SH2. Then, the recording sheet S is transposed by a transporting roller Ra as an example of the transporting member disposed on the reverse path SH2 and the recording sheet S is delivered to the registration roller Rr again in a state where the front and back sides of the recording sheet S are reversed.

In the printer U of Example 1, a paper feed module U6 is disposed below the apparatus main body U1. A sheet feeding tray TR2 is formed on an inside of the paper feed module U6. A second paper feeding path SH7 as an example of the transporting path is formed in a rear portion of the paper feed module U6. The second paper feeding path SH7 extends in the upward and downward direction. An upper end of the second paper feeding path SH7 is connected to a lower end of the first paper feeding path SH6.

Moreover, the sheet feeding tray TR2 of Example 1 has the same configuration as the manual feed tray TRI except that a length thereof in the forward and rearward direction is longer than that of the manual feed tray TR1. Therefore, similar to the manual feed tray TR1, a sheet feeding roll Rp', a moving-up-and-down plate PL1', and the like are disposed in the paper feed module U6. Therefore, the recording sheet S fed by the sheet feeding roll Rp' is transported to the first paper feeding path SH6. Moreover, the second paper feeding path SH7 is configured such that the recording sheet S is able to pass through below the paper feed module U6 and if the paper feed module U6 is added, is able to pass through from below the paper feed module U6.

Description of Charging Device

Figure 2A:
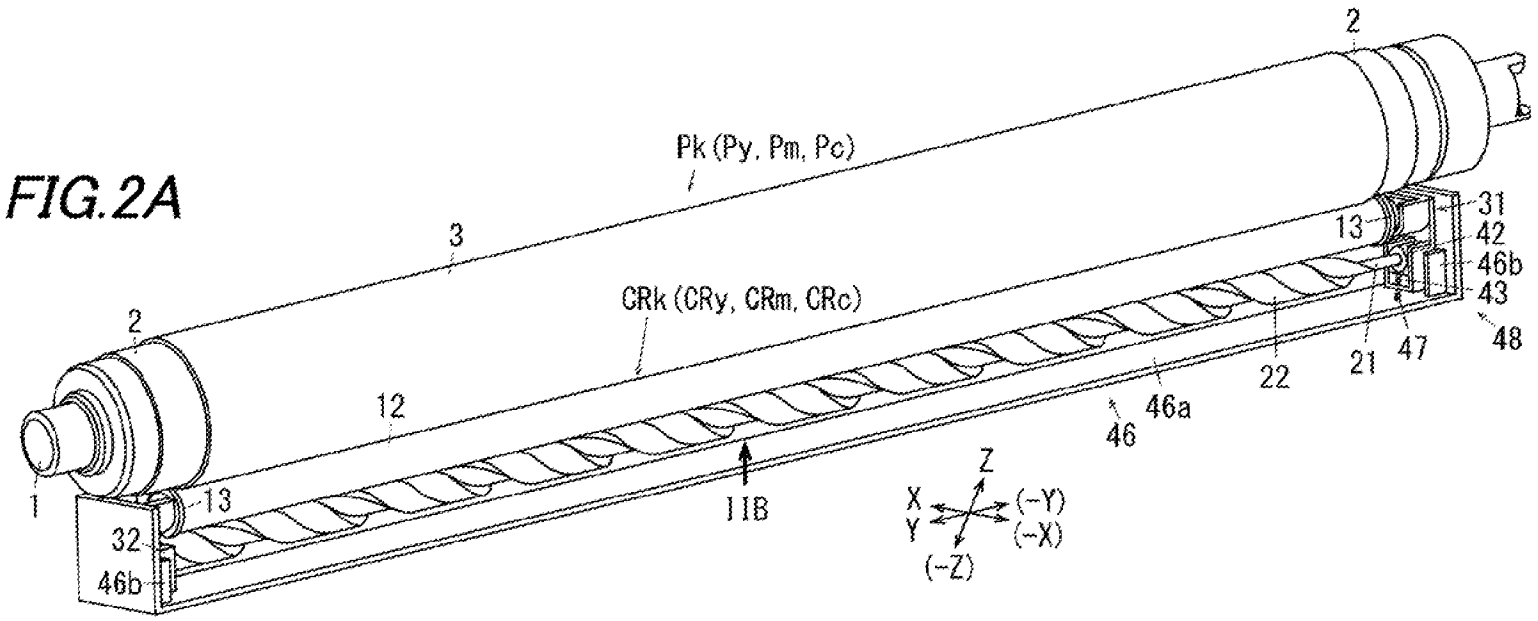
Figure 2B:
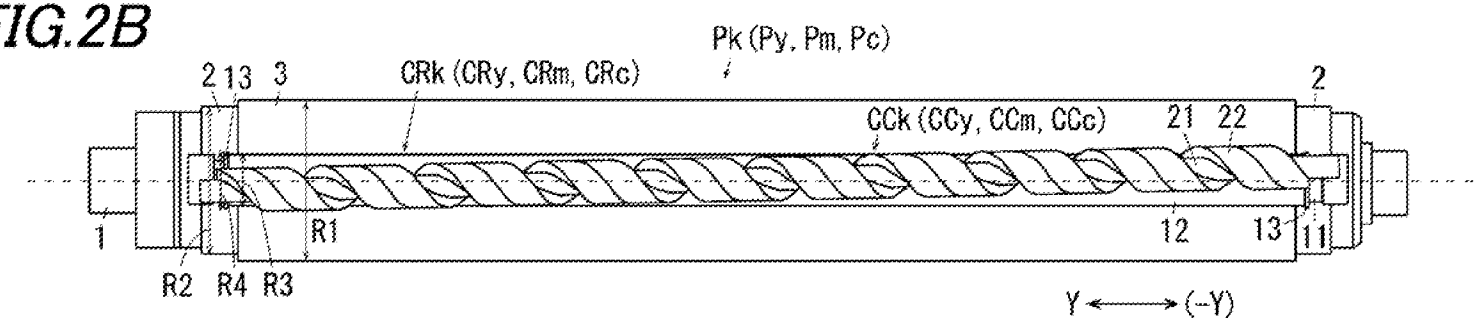

FIGS. 2A and 2B are explanatory views of the charging device and the image holding member of Example 1, FIG. 2A is a perspective view, and FIG. 2B is view that is viewed in arrow IIB direction of FIG. 2A.

Figure 3A:
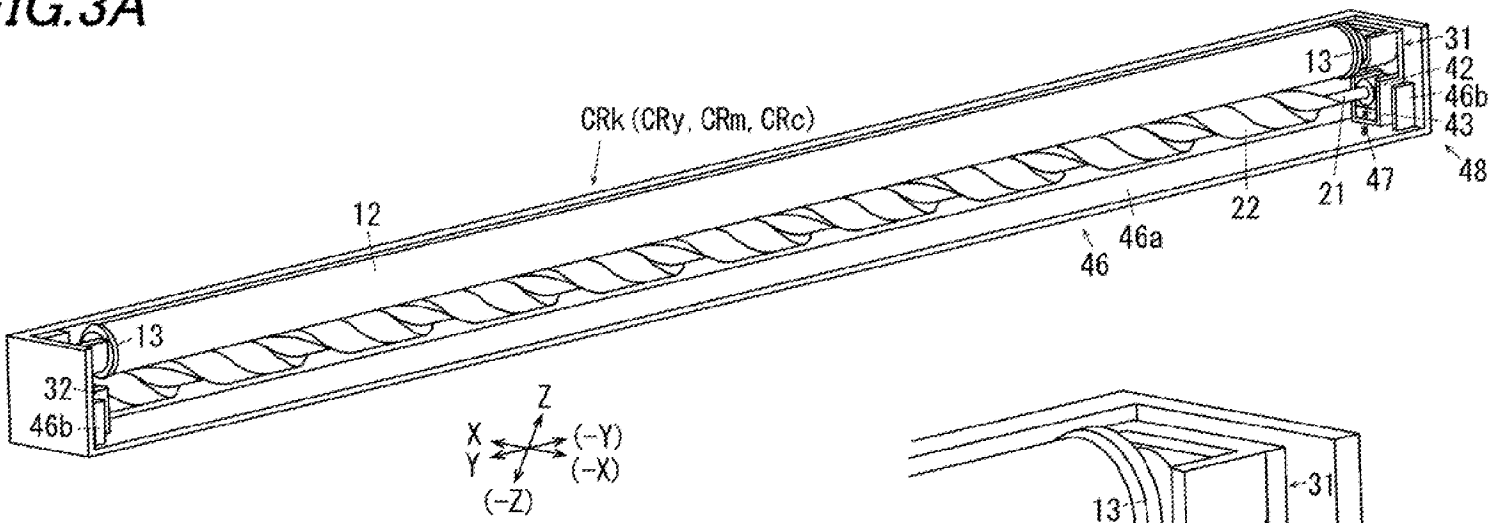
Figure 3B:
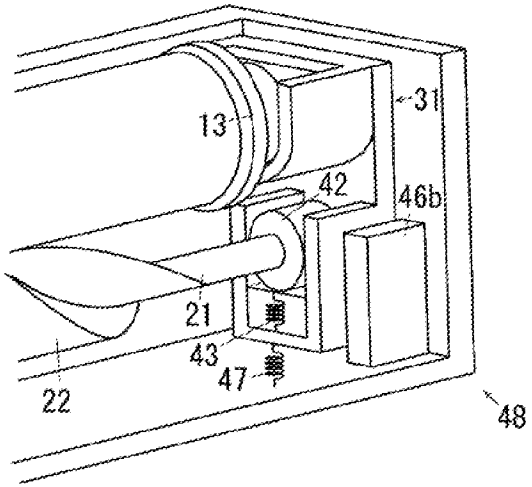

FIGS. 3A and 3B are explanatory views of the charging device of Example 1, FIG. 3A is a perspective view, and FIG. 3B is an enlarged view of a main portion.

Figure 4:
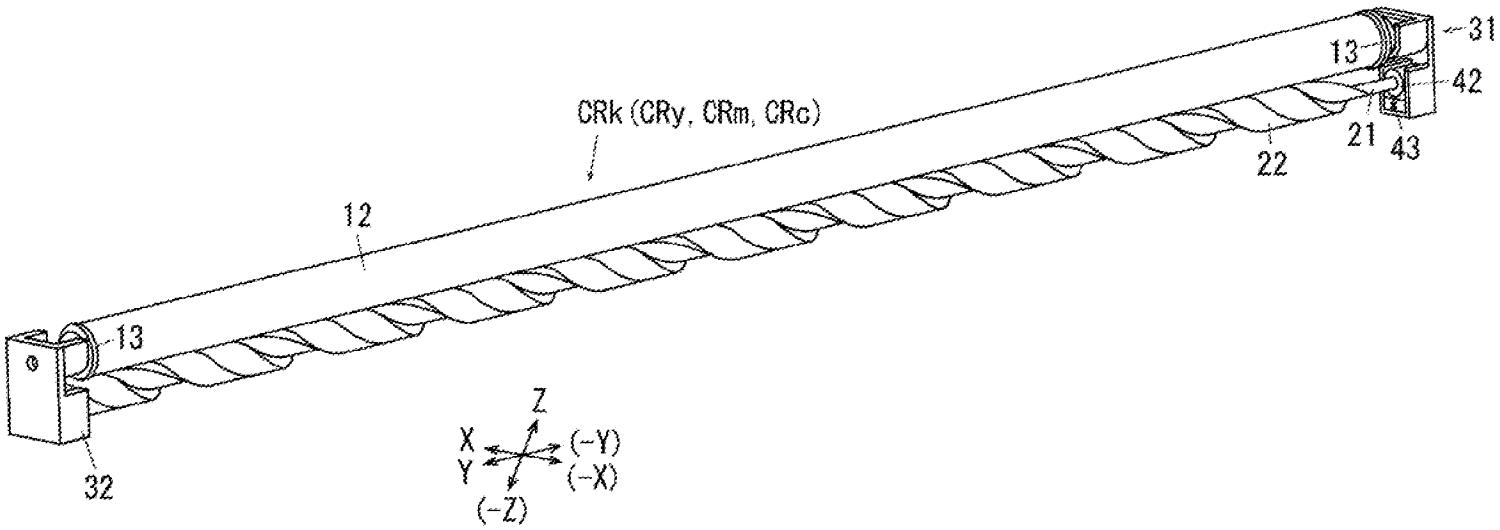
FIG. 4 is an explanatory view excluding a frame of the charging device of Example 1.

FIG. 4 is an explanatory view excluding a frame of the charging device of Example 1.

Figure 5A:
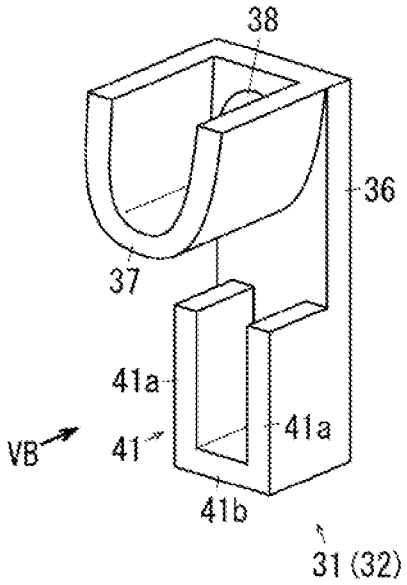
Figure 5B:
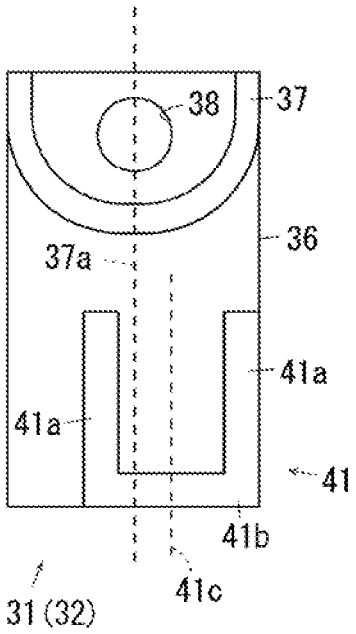

FIGS. 5A and 5B are explanatory views of the support member of Example 1, FIGS. 5A is a perspective view, and FIG. 5B is a view that is viewed in arrow VB direction of FIG. 5A.

Moreover, in the following description, the photoconductors Py to Pk and the charging device of each color of Y, M, C, and K have the same configuration. Thus, description will be made for only K color and the description will be omitted for the other Y, M, and C colors.

In FIGS. 2A to 3B, the photoconductor Pk of Example 1 is driven to be rotated around a rotation shaft 1. The photoconductor Pk has tracked portions 2 as an example of a gap set portion in both end portions in the axial direction. Moreover, a photoconductive layer 3 is not formed in the tracked portion 2 and an outer diameter R2 of the tracked portion 2 is formed to be smaller than an outer diameter R1 of the photoconductive layer 3 on an inside in the axial direction.

In FIGS. 2A to 3B, the charging roller CRk of Example 1 has a core member 11 as an example of the rotation shaft and a rubber member 12 as an example of a charging portion supported on an outer periphery of the core member 11. In FIG. 2B, the charging roller CRk of Example 1 is disposed such that the core member 11 is parallel to the rotation shaft 1 of the photoconductor Pk.

Tracking rollers 13 as an example of a gap setting portion are supported on both end portions of the rubber member 12 in the axial direction in the core member 11. The tracking rollers 13 are disposed to correspond to the tracked portions 2. In addition, an outer diameter R4 of the tracking roller 13 is formed to be greater than an outer diameter R3 of the rubber member 12. Moreover, a difference (R4-R3) between the outer diameter R4 of the tracking roller 13 and the outer diameter R3 of the rubber member 12 is set to be smaller than a difference (R1-R2) between the outer diameter R1 of the photoconductive layer 3 and the outer diameter R2 of the tracked portion 2. That is, it is set to be R4-R3<R1-R2. Therefore, in a state where the tracking roller 13 abuts against the tracked portion 2, the rubber member 12 is in contact with the photoconductive layer 3 in a state of being elastically deformed by an elastic deformation which is set in advance.

A charging cleaner CCk has a core member 21 as an example of the rotation shaft and a clean portion main body 22 that is spirally wound on an outer periphery of the core member 21.

In FIGS. 4 to 5B, both end portions of the charging roller CRk and the charging cleaner CCk in the axial direction are supported by a left bearing member 31 as an example of a first support member and a right bearing member 32 as an example of a second support member. In Example 1, the left bearing member 31 and the right bearing member 32 are only disposed symmetrically laterally and have the same configuration. That is, the same component is used.

The bearing members 31 and 32 have wall portions 36. The wall portion 36 is formed in a plate shape extending in a direction in which the charging roller CRk approaches and separates with respect to the photoconductor Pk. A charging bearing portion 37 rotatably supporting the core member 11 of the charging roller CRk is formed on the wall portion 36 on the photoconductor Pk side. The charging bearing portion 37 is formed in a substantially U shape in which the photoconductor Pk side is opened. Moreover, an opening 38 is formed on the wall portion 36 to correspond to the charging bearing portion 37. A voltage for charging is able to be supplied to the charging roller CRk by an electrically conductive member (not illustrated) via the opening 38.

A cleaner support portion 41 as an example of a clean support portion is formed below the charging bearing portion 37. The cleaner support portion 41 has a pair of front and rear guide walls 41*a* extending in a direction approaching and separating with respect to the photoconductor Pk. In addition, a spring support wall 41*b* as an example of a support portion of an urging member is formed on a side of the guide walls 41*a* farther from the photoconductor Pk.

In FIG. 5B, a center 41*c* of the pair of guide walls 41*a* in the forward and rearward direction is set in a position eccentric to the front side with respect to a center 37*a* of the charging bearing portion 37 in the forward and rearward direction. Therefore, in the charging roller CRk and the charging cleaner CCk supported on the bearing members 31 and 32 which are symmetrically laterally, as illustrated in FIG. 2B, the core member 21 of the charging cleaner CCk is supported in a state of being inclined with respect to the charging roller CRk in the axial direction.

In FIGS. 2A to 4, the core member 21 of the charging cleaner CCk rotatably supported by a bearing 42. The bearing 42 is supported on the cleaner support portion 41 in a state of being movable along guide walls 41*a*. A first spring 43 as an example of an urging member is supported between the bearing 42 and the spring support wall 41*b*. The first spring 43 exerts a force for urging the charging cleaner CCk toward the charging roller CRk.

In addition, a frame 46 as an example of a frame body of the charging device is disposed on an outside of the bearing members 31 and 32. The frame 46 is disposed so as to surround the charging roller CRk and the charging cleaner CCk. A second spring 47 as an example of an urging member is supported between a bottom wall 46*a* of the frame 46 and the bearing members 31 and 32. The second spring 47 exerts a force for urging the charging roller CRk toward the photoconductor Pk. Furthermore, a guide wall 46*b* for guiding the bearing members 31 and 32 in a direction approaching and separating with respect to the photoconductor Pk is formed in the bottom wall 46*a*.

A charging device 48 of Example 1 is configured of the charging roller CRk, the charging cleaner CCk, the bearing members 31 and 32, the bearing 42, the springs 43 and 47, the frame 46, and the like.

Operation of Example 1

In the printer U as an example of the image forming apparatus of Example 1 including the configuration elements described above, the charging cleaner CCk is supported on the charging roller CRk to be inclined. Here, the charging cleaner CCk is pressed by the first springs 43 disposed both ends in the axial direction toward the charging roller CRk.

In a configuration of the related art in which a photoconductor, a charging roller, and a charging cleaner are disposed in parallel, both ends are pushed by springs. Therefore, there is a problem that contact conditions between the charging roll and the photoconductors, that is, a contact area and a contact pressure are different in a center portion in the axial direction and an end portion in the axial direction due to bending of the charging roll and the like. Therefore, the difference in the charging conditions is generated in accordance with the difference in the contact conditions and thereby it causes charging unevenness.

In addition, the rotation shaft of the photoconductor to be driven is actually eccentric from the rotation center by a manufacturing error and accuracy, and a degree of eccentricity is individually different. Therefore, if the charging roll cannot follow unevenness of periodical rotation in accordance with the eccentricity of the photoconductor, particularly, there is also a problem that a contact pressure is likely to be insufficient in the center portion in the axial direction.

Figure 6A:
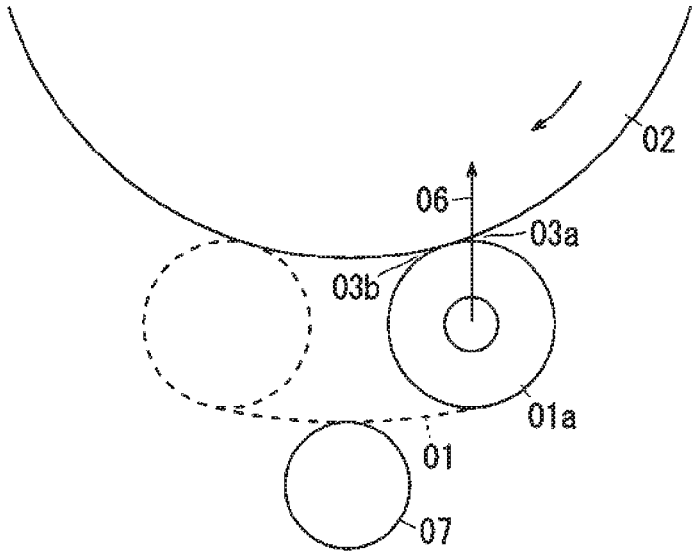
Figure 6B:
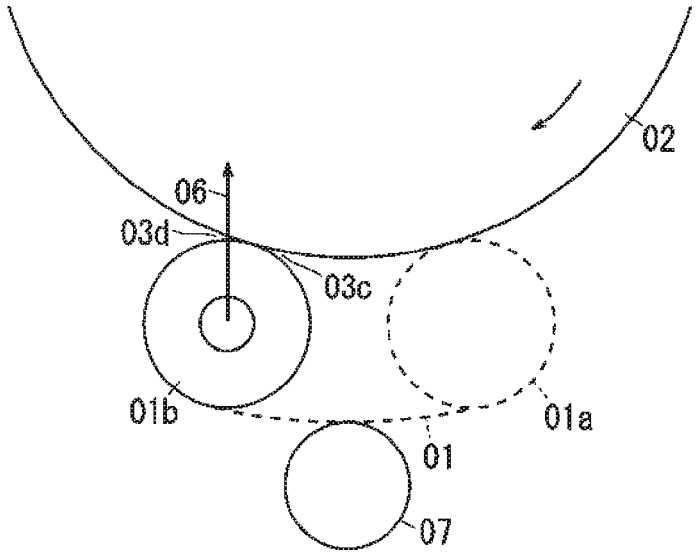
Prior Art FIG.6B

FIGS. 6A and 6B are explanatory views in a case where a charging roll is inclined with respect to a photoconductor. FIG. 6A is an explanatory view of an upstream side, and FIG. 6B is an explanatory view of a downstream side.

In contrast, as indicated in the technique described in JP-A-2007-121892, in a configuration in which a rotation shaft of a charging roll is inclined with respect to a rotation shaft of a photoconductor, the charging roll has a form to be wound around the photoconductor by deflection. Therefore, if a contact area and a contact pressure are likely to be ensured even in a center portion in the axial direction. However, as indicated in JP-A-2007-121892, if a charging roller 01 is inclined with respect to a photoconductor 02, since urging directions 06 are the same in as blade, as illustrated in FIG. 6A, in one end side 01*a* of the charging roller 01, a wedge-shaped space 03*a* on an upstream side is wider than a wedge-shaped space 03*b* on a downstream side with respect to the photoconductor 02, but as illustrated in FIG. 6B, in the other end side 01*b* of the charging roller 01, a wedge-shaped space 03*c* on the upstream side is narrower than a wedge-shaped space 03*d* on the downstream side with respect to the photoconductor 02. That is, a discharging condition is different in one end side 01*a* and the other end side 01*b*. Therefore, there is a problem that uniformity of charging is deteriorated and image quality is degraded on a surface of the photoconductor 02 compared to a case where the charging roller 01 is not inclined.

In addition, it is necessary to enhance accuracy of components of a bearing and a spring to dispose the charging roller 01 in the both ends 01*a* and 01*b* at an even angle around the photoconductor 02 and in practice, there is also a problem that an inclined angle of the charging roller 01 with respect to the photoconductor 02 is not stabilized in a component dimension difference, a manufacturing error, and the like. If an inclination of a shaft of the charging roller 01 is shifted more than setting, there is a concern that a driven property of the charging roller 01 with respect to the photoconductor 02 is lowered and the charging roller 01 is idle. If the charging roller 01 is idle, there is also a problem that local wear of the charging roller 01 and the photoconductor 02 is likely to occur and evenness of charging is worsened over time. In addition, if the charging roller 01 is idle, there is a problem that cleaning performance of a charging cleaner 07, which is driven by the charging roller 01, is deteriorated. In addition, if setting of rotation unevenness and the inclination of the charging roller 01 in the axial direction caused by eccentricity of the photoconductor 02 are combined, in the worst, case, there is also a concern that the contact area and the contact pressure between the charging roller 01 and the photoconductor 02 are insufficient and a charging amount is lowered.

In contrast, in the printer U of Example 1, the charging rollers CRy to CRk are disposed parallel to the photoconductors Py to Pk, and the axial direction of the charging cleaners CCy to CCk is inclined with respect to the charging rollers CRy to CRk. Therefore, unevenness of the discharging condition does not occur as illustrated in FIGS. 6A and 6B compared to the case where the charging roller 01 is inclined with respect to the photoconductor 02 as described in JP-A-2007-121892. Therefore, the charging unevenness of the photoconductors Py to Pk is reduced.

In addition, the first spring 43 is pressed in a form in which the inclined charging cleaners CCy to CCk are wound around the charging rollers CRy to CRk. Therefore, even if the charging rollers CRy to CRk are deflected in the axial direction, the deflection thereof caused by being pressed to the charging cleaners CCy to CCk is corrected. Therefore, unevenness of charging of the photoconductors Py to Pk is reduced.

Furthermore, in Example 1, the left bearing member 31 and the right bearing member 32 are used by symmetrically disposing components having the same configuration. Therefore, the center portion of the charging cleaners CCy to CCk in the axial direction and the center portion of the charging rollers CRy to CRk in the axial direction (rightward and leftward direction) are always matched. Moreover, if different components are used in one end and the other end in the axial direction, there is a concern that the center portions are not matched in the irregularity of the components. Therefore, in Example 1, the center portion of the charging cleaners CCy to CCk may be reliably in contact with the center portion of the charging rollers CRy to CRk in the axial direction that is a position which the deflection is the maximum. Particularly, the center portion of the charging cleaners CCy to CCk is a position in which the contact area and the contact pressure of the charging cleaners CCy to CCk are the maximum, and is a position in which the deformation of the charging rollers CRy to CRk is the maximum when being in contact with the charging rollers CRy to CRk to be wound around the charging cleaners CCy to CCk. Therefore, the charging cleaners CCy to CCk of Example 1 can be reliably press the position in which the deflection of the charging rollers CRy to CRk is the maximum to the position in which the contact area and the like are the maximum. Therefore, variation of the contact position caused by the irregularity of the components is reduced and the unevenness of charging of the photoconductors Py to Pk is further reduced compared to a case where different components are used in one end and the other end in the axial direction.

Therefore, a positional relationship between the charging cleaners CCy to CCk and the charging rollers CRy to CRk is likely to be stabilized and the problem of the evenness of charging is likely to be suppressed. In addition, if the positional relationship between the charging cleaners CCy to CCk and the charging rollers CRy to CRk is stabilized, a relationship between the charging rollers CRy to CRk and the photoconductors Py to Pk is also likely to be stabilized. Therefore, the driven property of the charging rollers CRy to CRk with respect to the photoconductors Py to Pk is also unlikely to be lowered and the driven property of the charging cleaners CCy to CCk with respect to the charging rollers CRy to CRk is also unlikely to be lowered. Therefore, the problems of the wear and the cleaning property are also reduced compared to the configuration described in JP-A-2007-121892.

Furthermore, in Example 1, in the tracking roller 13 and the second spring 47, the relationship between the charging rollers CRy to CRk and the photoconductors Py to Pk is defined. Therefore, even if there is the rotation unevenness caused by the eccentricity of the photoconductors Py to Pk, the positional relationship between the charging rollers CRy to CRk and the photoconductors Py to Pk is likely to be stabilized compared to a configuration which does not have the tracking roller 13 and the second spring 47. Therefore, even if there is the rotation unevenness caused by the eccentricity of the photoconductors Py to Pk, the charging unevenness is reduced.

EXAMPLE 2

Figure 7:
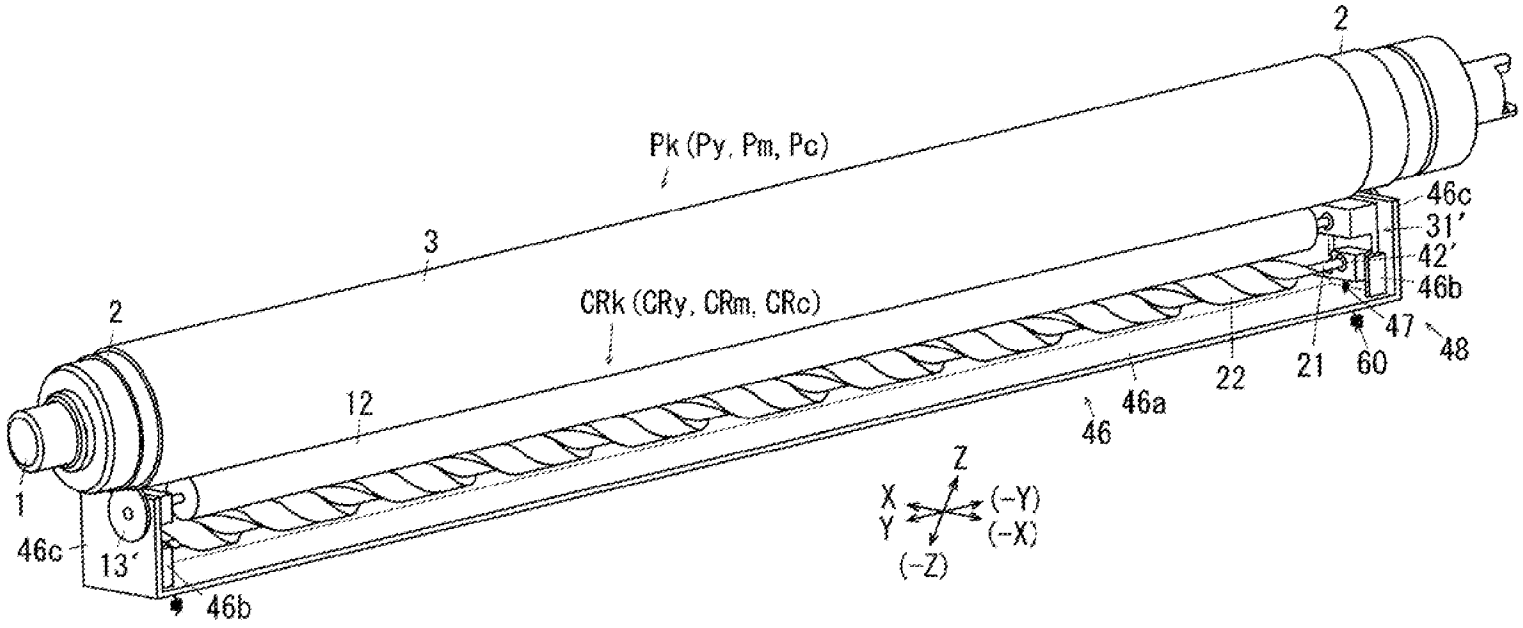
FIG. 7 is an explanatory view of a charging device and an image holding member of Example 2 and is a view corresponding to FIG. 2A of Example 1.
Figure 8:
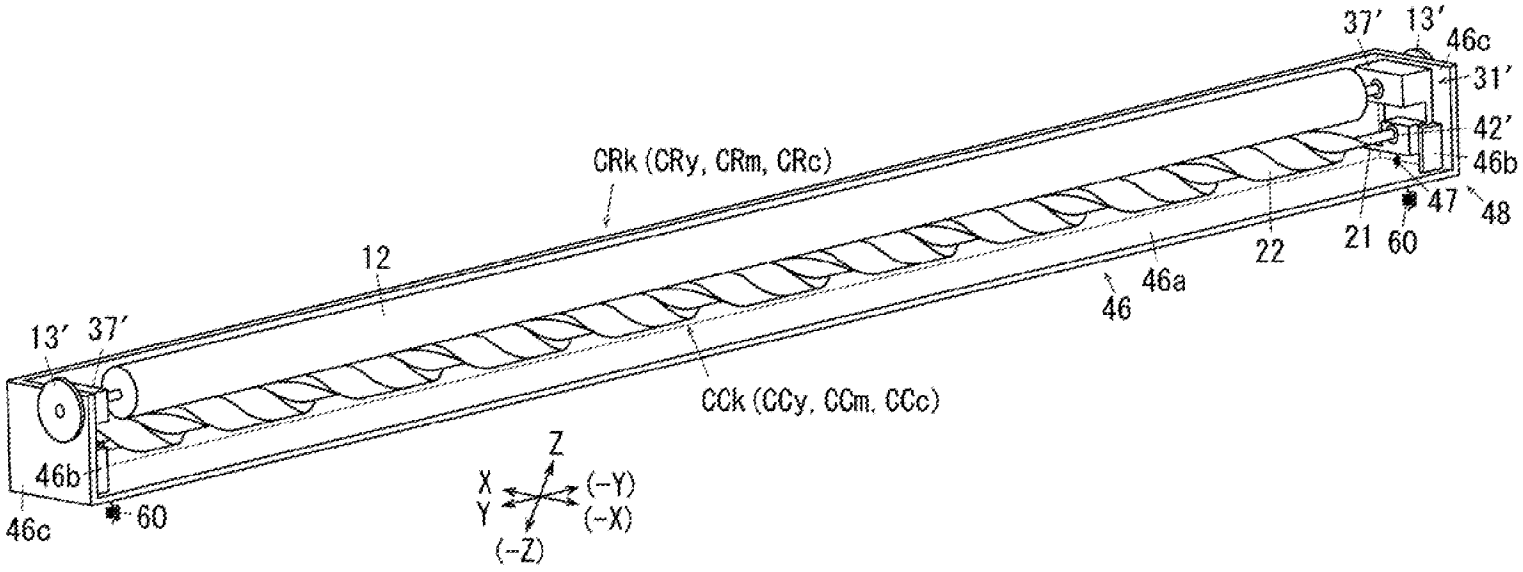
FIG. 8 is an explanatory view of the charging device of Example 2 and is a view corresponding to FIG. 3A of Example 1.

FIG. 7 is an explanatory view of a charging device and an image holding member of Example 2 and is a view corresponding to FIG. 2A of Example 1;

FIG. 8 is an explanatory view of the charging device of Example 2 and is a view corresponding to FIG. 3A of Example 1.

Figure 9A:
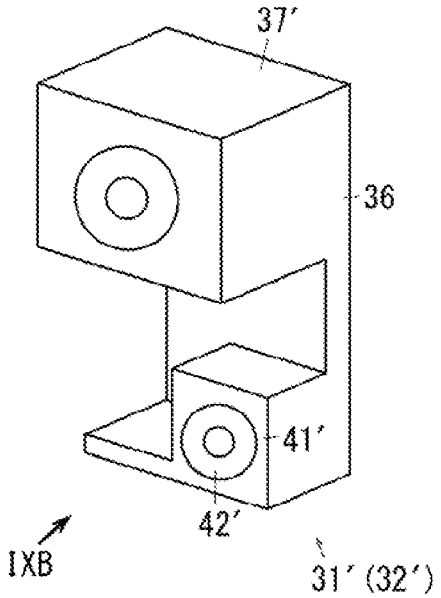
Figure 9B:
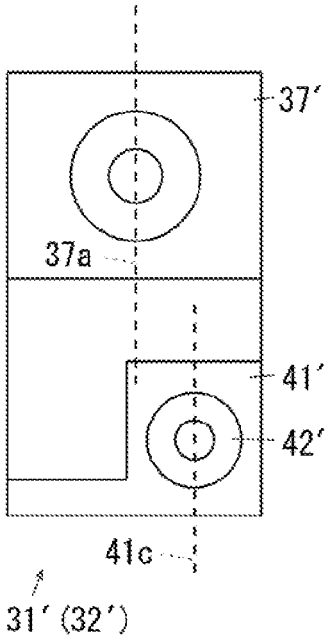

FIGS. 9A and 9B are explanatory views of a support member of Example 2, FIG. 9A is a perspective view, and FIG. 9B is a view that is viewed in arrow IXB direction of FIG. 9A.

Moreover, in the description of Example 2, the same reference numerals are given to configuration elements corresponding to the configuration elements of Example 1 described above and the detailed description thereof will be omitted.

Example 2 is different from Example 1 in the following configurations and has the same configurations as those of Example 1 in other configurations.

In FIGS. 7 to 9B, tracking rollers 13' of Example 2 are not supported on a charging roller CRk and are rotatably supported on both right and left side walls 46*c* of a frame 46. In addition, in Example 2, a third spring 60 as an example of an urging member is supported between the frame 46 and an apparatus main body U1. The third spring 60 of Example 2 acts a force in a direction in which the frame 46 is pressed with respect to a photoconductor Pk. Therefore, the tracking roller 13' is held in a state of being in contact with a tracked portion 2 of the photoconductor Pk by the elastic force of the third spring 60.

In addition, the charging roller CRk of Example 2 is rotatably supported on a charging bearing portion 37'. In addition, a charging cleaner CCk is rotatably supported on a cleaner bearing portion 42' of each of bearing members 31' and 32'. Moreover, in Example 2, a first spring 43 is not provided and the charging cleaner CCk is supported on the charging roller CRk in a state of being in contact with the charging roller CRk by a gap between a bearing 61 and the cleaner bearing portion 42'. That is, Example 2 does not employ a constant load system in which the charging cleaner is pressed by a pressure which is set in advance by using the first spring 43 illustrated in Example 1 and employs a constant displacement system in which an elastic deformation amount and an interference of the charging cleaner CCk to the charging roller CRk are amounts which are set in advance and thereby the charging cleaner CCk is in contact with the charging roller CRk by a pressure which is set in advance.

Operation of Example 2

In a charging device of Example 2 including the configuration described above, similar to Example 1, the right bearing members 31' and 32' are used by symmetrically disposing components having the same configuration. Therefore, the same operational effects as those of Example 1 are provided. In addition, in the charging device of Example 2, unlike Example 1, a tracking mechanism having the tracking roller 13' and the third spring 60 sets a gap between charging rollers CRy to CRk and photoconductors Py to Pk.

Here, a rotation center of the photoconductors Py to Pk is eccentric in reality caused by a manufacturing error and irregularity of the component, and the like. Similarly, the charging rollers CRy to CRk are also eccentric. As in the configuration of Example 1, if the tracking roller 13 is provided in the charging rollers CRy to CRk, a function of which the tracking roller 13 is in contact with the tracked portion 2 due to eccentricity of the photoconductors Py to Pk and a function of which the charging rollers CRy to CRk are pressed against the photoconductors Py to Pk by a pressure which is set in advance are handled by one first spring 43. Therefore, the eccentricity of the photoconductors Py to Pk and the eccentricity of the charging rollers CRy to CRk are overlapped, and stretch of the first spring 43 is increased. That is, in the configuration of Example 1, if the driven property and responsibility of the charging rollers CRy to CRk with respect to the photoconductors Py to Pk are deteriorated, for example, when the diameter of the photoconductors Py to Pk is small, the charging rollers CRy to CRk cannot rapidly approach the photoconductors Py to Pk, the contact area is momentarily small, and a gap may be provided. Therefore, if the driven property and responsibility are deteriorated, there is a concern that the contact area between the photoconductors Py to Pk and the charging rollers CRy to CRk is widened or narrowed, and there is a concern that the charging unevenness may occur.

In addition, in a case where the charging rollers CRy to CRk are driven by an eccentric rotation of the photoconductors Py to Pk, if the driven property and the responsibility are deteriorated, in a configuration in which the charging rollers CRy to CRk are pressed by the first springs 43 on both ends in the axial direction, balance may be lost in one end and the other end in the axial direction. If the balance is lost in both ends, there is a concern that unevenness occurs in a pressing force and the charging unevenness occurs.

Moreover, even in a non-contact charging system in which a gap is provided between the photoconductors Py to Pk and the charging rollers CRy to CRk, if the tracking, mechanism is provided as in Example 1, there is a problem that a size of the gap is varied and the charging unevenness occurs due to the eccentricity of the photoconductors Py to Pk and the charging rollers CRy to CRk.

In contrast, in the charging device of Example 2, the gap between the charging rollers CRy to CRk and the photoconductors Py to Pk is handled by the third spring 60 and the contact pressure of the charging rollers CRy to CRk with respect to the photoconductors Py to Pk is handled by the second spring 47. Therefore, the driven property and the responsibility are likely to be improved compared to a case where the two functions are handled by one spring. Therefore, occurrence of the charging unevenness is reduced.

Particularly, in Example 2 the bearing members 31' and 32' supporting the charging rollers CRy to CRk are pressed by the second spring 47 disposed between the bearing members 31' and 32', and the frame 46. Therefore, in Example 2 each of the bearing members 31' and 32' is supported by the second spring 47 on the basis of the frame 46 of which tracking is adjusted by the third spring 60. Therefore, a change of a contact state due to the eccentricity of the charging rollers CRy to CRk is adjusted by the second spring 47. Therefore, if the second spring 47 is disposed between the bearing member and the apparatus main body U1 rather than the frame 46, the eccentricity of the photoconductors Py to Pk is also affected in addition to the eccentricity of the charging rollers CRy to CRk. However, in Example 2, adverse effects of the eccentricity of the charging rollers CRy to CRk are reduced and variation of the contact area and the like between the charging rollers CRy to CRk and the photoconductors Py to Pk is reduced Modification Example Above, the examples of the invention are described in detail, but exemplary embodiments of the invention are not likely to the examples and various modulations can be performed within the scope, of the exemplary embodiments of the invention described in the claims. Modification examples (H01) to (H05) of the exemplary embodiments of the invention ire illustrated as follows.

(H01) In the examples described above, the printer U is illustrated as the image forming apparatus, but the image forming apparatus is not limited to the printer U and a FAX, a copier, and a multifunction machine having both or plural functions may be included. In addition, the image forming apparatus is not limited to a color image forming apparatus and may be configured by a monochrome image forming apparatus.

(H02) In the examples described above, a configuration in which the intermediate transfer belt is used as the intermediate transfer body, but the intermediate transfer body is not limited to the intermediate transfer belt and a configuration is which the intermediate transfer drum is used may be included. In addition, the transfer device having the intermediate transfer body is illustrated as the transfer device, but the transfer device is not limited to the configuration and, for example, a configuration in which the intermediate transfer body is omitted and the toner image is directly transferred from the photoconductors Py to Pk to the recording sheet S as a transfer receiver may be included.

(H03) In the examples described above, the drum-shaped photoconductors Py to Pk are exemplified, but the configuration is not limited to the drum-shaped photoconductors Py to Pk. For example, a belt-shaped photoconductor may be used.

(H04) In the examples described above, as the charging cleaners CCy to CCk, the configuration having the clean portion main body 22 that is provided by spirally winding the shaft on the outer periphery of the core member 21 is exemplified, but the configuration is not limited to thereto. For example, similar to the charging rollers CRy to CRk, a roll-shaped configuration may be included.

(H05) In the examples described above, the configuration applied to the small-sized image forming apparatus is exemplified, but the configuration may be applied to a medium-sized or a large-sized image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charging member that rotates around a rotation shaft of the charging member and that charges a surface of an image holding member by being in contact with the surface of the image holding member, wherein the rotation shaft of the charging member is disposed parallel to a rotation shaft of the image holding member;

a cleaning member that rotates around a rotation shaft of the cleaning member and that cleans the charging member by being in contact with the charging member, wherein the rotation shaft of the cleaning member is disposed to incline with respect to the rotation shaft of the charging member;

a first support member that supports one end portion of the charging member and that supports one end portion of the cleaning member; and a second support member that supports the other end portion of the charging member, that supports the other end portion of the cleaning member, that has the same configuration as a configuration of the first support member, and that is disposed symmetrically with the first support member with the charging member interposed between the first and second support members, the rotation shaft of the cleaning member being fixed so that an inclination angle and an inclination direction of the rotation shaft of the cleaning member with respect to the rotation shaft of the charging member are not changed in association with rotation of the cleaning member.

2. An image forming apparatus comprising:

the image holding member;

the charging device according to claim 1 that charges the surface of the image holding member;

a latent image forming device that forms a latent image on the surface of the charged image holding member;

a developing device that develops the latent image on the image holding member into a visible image;

a transfer device that transfers the visible image on the surface of the image holding member to a medium; and a fixing device that fixes the visible image transferred to the medium.

* * * * *